US005755623A

United States Patent [19]

Mizenko

[11] Patent Number: 5,755,623

[45] Date of Patent: May 26, 1998

[54] LEVEL ACCESSORY FOR GOLF PUTTERS

[76] Inventor: John M. Mizenko, 4717 225th Ave. SE., Issaquah, Wash. 98029

[21] Appl. No.: 766,303

[22] Filed: Dec. 13, 1996

Related U.S. Application Data

[60] Provisional application No. 60/008,941 Dec. 21, 1995.

[51] Int. Cl.[6] ..... A63B 69/36

[52] U.S. Cl. ..... 473/241; 473/404; 33/384

[58] Field of Search ..... 473/241, 282, 473/404; 33/384

[56] References Cited

U.S. PATENT DOCUMENTS

| | | | |
|---|---|---|---|
| D. 306,335 | 2/1990 | Franey | D21/234 |
| 2,919,491 | 1/1960 | Darrell et al. | 33/207 |
| 3,182,401 | 5/1965 | Stevens | 473/404 X |
| 3,908,991 | 9/1975 | Schwartz | 273/32 R |
| 4,079,520 | 3/1978 | Davis | 33/334 |
| 4,082,286 | 4/1978 | LaBreche | 273/162 |
| 4,179,125 | 12/1979 | Cone et al. | 273/162 |
| 4,211,415 | 7/1980 | Lindo | 473/241 |
| 4,258,475 | 3/1981 | Buckley | 33/283 |
| 4,575,090 | 3/1986 | Heseltine et al. | 273/183 |
| 4,902,014 | 2/1990 | Bontomase | 273/162 |
| 5,330,179 | 7/1994 | Hampel | 273/32 |
| 5,385,349 | 1/1995 | Marshall | 473/241 X |
| 5,409,212 | 4/1995 | Arnett | 273/32 B |
| 5,431,391 | 7/1995 | Tracey | 473/404 X |

OTHER PUBLICATIONS

See Level ™ Green Reader by Bell Poducts, Arlington Heights, Illinois 60006 Read–Em–Rite™ product by (1990) The Kensington Group.

*Primary Examiner*—George J. Marlo
*Attorney, Agent, or Firm*—Roy E. Mattern, Jr.

[57] ABSTRACT

A golf green level determining removable accessory for temporary securement to a shaft of a golf putter, to in effect create a level tool having the length of the golf putter. With this accessory temporarily in place, the golfer lays his or her putter at selected places on the contour of the grass surface of a golf green to determine the respective slope in the selected locale. A housing of this accessory positions and holds an elongated sealed liquid and air level; receives and holds at least one magnet; temporarily receives, via a concave portion thereof, a portion of the shaft of a golf putter; receives some calibration shims or an adjustable set screw, to initially, when necessary, adjust the level air bubble at the zero position, when the golf putter is laid on a known level underlying surface with the accessory in the temporary position thereof. If a golf putter has a nonmetallic shaft, then a metal snap on partial sleeve is placed on this shaft. Then the magnet is effective in positioning this accessory on the shaft of the putter. Preferably, the accessory has a pointed end, or an otherwise distinguishable end, to insure the same directional placement of the accessory on the shaft of the golf putter. Preferably the accessory is carried by the golfer in his pocket, until the accessory is to be used, or supported in or on a golf bag.

6 Claims, 3 Drawing Sheets

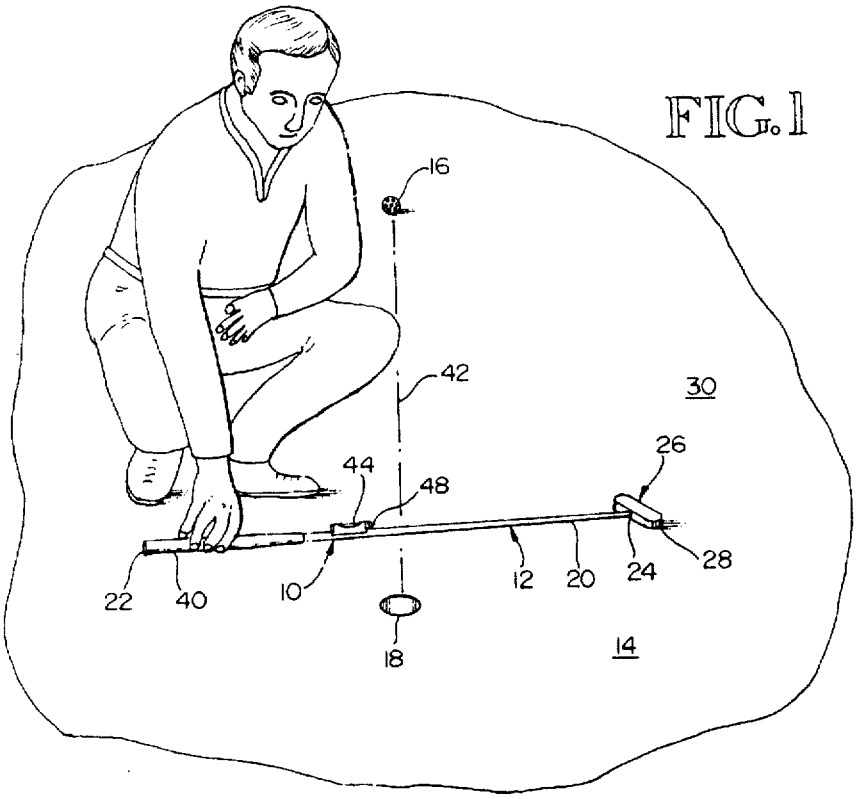
FIG. 1
FIG. 3
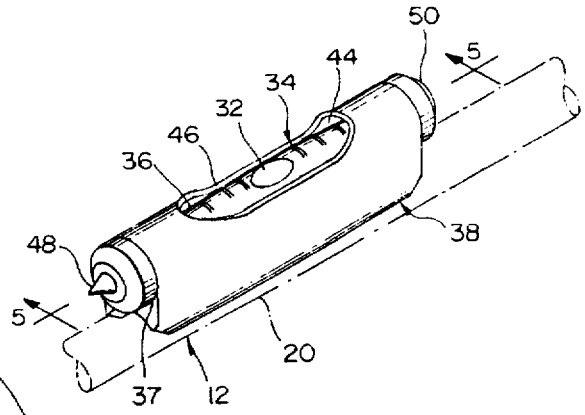
FIG. 2
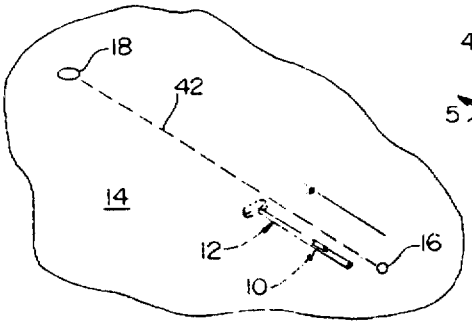

FIG. 4
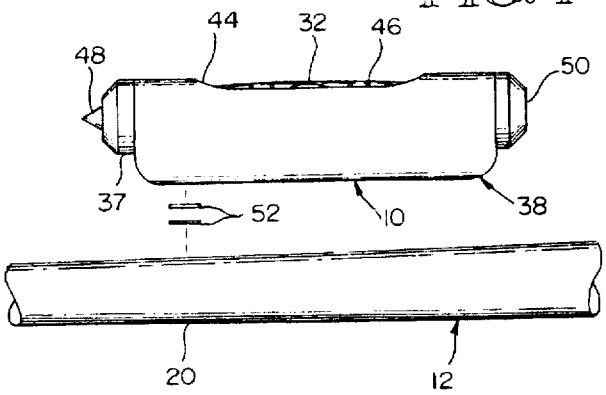
FIG. 5
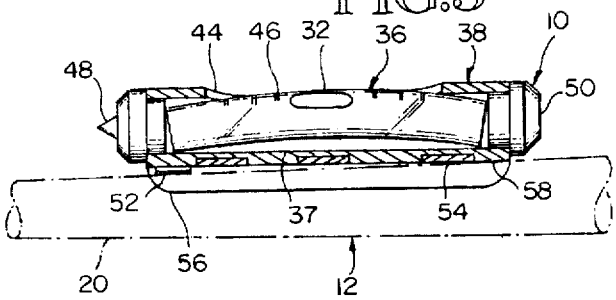
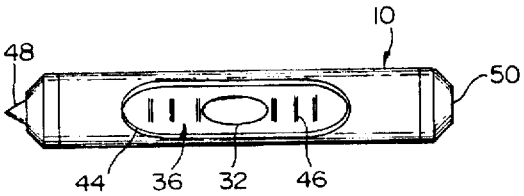
FIG. 6
FIG. 7
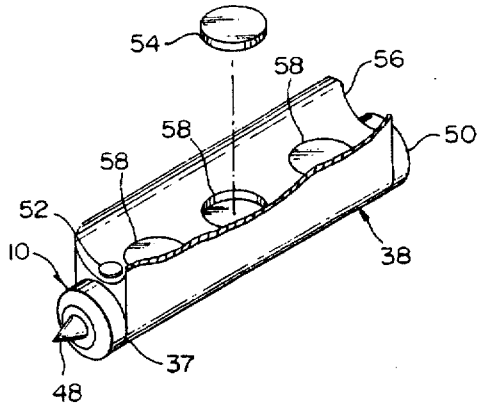

FIG. 8
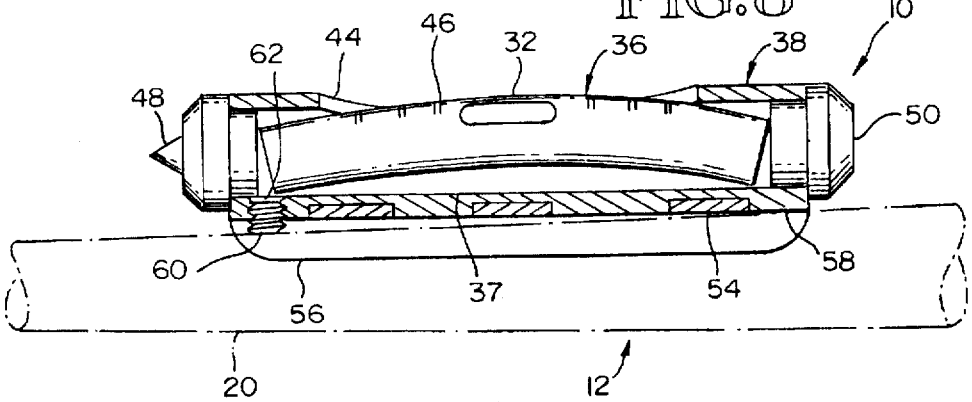
FIG. 9
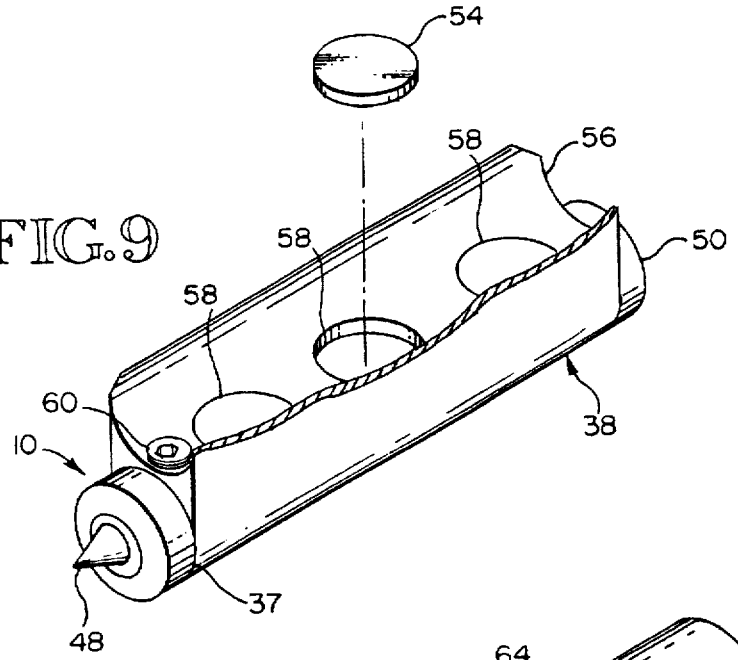
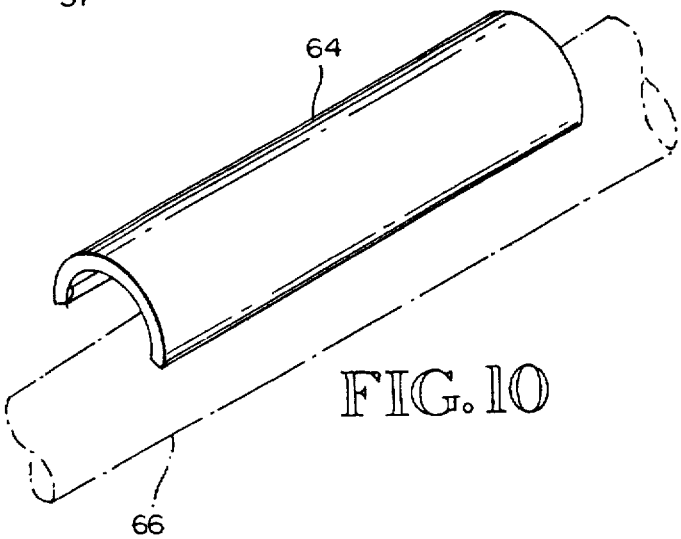
FIG. 10

LEVEL ACCESSORY FOR GOLF PUTTERS

CROSS REFERENCE

A Provisional Application, Ser. No. 60/008,941, was filed on Dec. 21, 1995, with the same title, by the same Applicant, and the priority thereof is hereby claimed.

A golf green level determining removable accessory for temporary securement to a shaft of a golf putter, to in effect create a level tool having the length of the golf putter. With this accessory temporarily in place, the golfer lays his or her putter at selected places on the contour of the grass surface of a golf green to determine the respective slope in the selected locale. A housing of this accessory positions and holds an elongated sealed liquid and air level; receives and holds at least one magnet; temporarily receives, via a concave portion thereof, a portion of the shaft of a golf putter; receives some calibration shims or an adjustable set screw, to initially, when necessary, adjust the level air bubble at the zero position, when the golf putter is laid on a known level underlying surface with the accessory in the temporary position thereof. If a golf putter has a nonmetallic shaft, then a metal snap on partial sleeve is placed on this shaft. Then the magnet is effective in positioning this accessory on the shaft of the putter. Preferably, the accessory has a pointed end, or an otherwise distinguishable end, to insure the same directional placement of the accessory on the shaft of the golf putter. Preferably the accessory is carried by the golfer in his pocket, until the accessory is to be used, or supported in or on a golf bag.

BACKGROUND

Most golfers experience difficulty in correctly determining the contours of golf course greens. They must consider one or more of the following, if the putting line is not, at the outset, considered to be straight away and level, does the green slope to the right, to the left, both to right and left enroute to the cup, downhill, uphill, and both uphill and downhill?

In the past and currently golfers have the opportunity of using, during practice and sometimes, if permitted, during tournaments, products which assist them in determining these various directional contours of golf course greens.

In respect to such products which are not attached to or built into a golf club such as the putter, there are for example:

In U.S. Pat. No. 4,258,475, in 1981, Robert D. Buckley disclose his golfers' sighting device, which is a thin hollow rectangular translucent liquid container, having a top tapered finger manipulated handle. The golfer using his thumb and forefinger holds this sighting device at his or her eye level to determine the transverse slope of the contour of the golf green;

In U.S. Pat. No. 5,330,179, in 1994, Frederick E. Hampel illustrated and disclosed his golfer's putting aid. He refers to this aid as a gauge having two parts pivoted relative to one another. One part is a base having measure indicia at each end, and a level on one edge. The second part is a sighting element having pointers at each end to point to the respective measure indicia on the base. At the location of use on the green, the golfer at his or her eye level arranges the base in a level position. Then he or she pivots the sighting element to match the observed slope of the contour of the green;

In U.S. Pat. No. 5,409,212, in 1995, Harold B. Arnett, disclosed his combination ball mark repair tool, and golf green slope indicator. It is positioned on the grass surface of a golf green, and the bubble-type level positioned on this combination is read to determine the slope of the contour of the green. This product in the marketplace is identified as to its source by the trademark, The Putt Partner; and In respect to a product sold by Bell Products Inc. of Arlington Heights, Ill. 60006, which is referred to as the green reader, and designated by the trademark See-Level, the golfer holds at his or her eye level a translucent rectangular container of partially filled liquid, with indicia presented in reference to vertical and horizontal intersecting lines, to view the green contour between the golf ball and the cup of the green, and to thereby determine the slope of the grass surface of the green.

In respect to such products which are temporarily attached to a golf putter, there are for example:

In U.S. Pat. No. 3,908,991, in 1975, Erving H. Schwartz illustrated and described his putting aid. When folded up, the putting aid is carried in a golf bag. When used, the putting aid is unfolded. A vertical member is clipped to the shaft of the putter. A pivotal horizontal member, with a bubble-type level, is arranged at ninety degrees to the shaft of the putter. Then the putting aid on the putter is lifted, and when the horizontal member is level, the golfer using one or both of two pivotal sighting bars determines the slope angle or angles of the grass surface of the contour of the green, between the golf ball and the cup of the green;

In U.S. Design Pat. No. D306,335, in 1990, Joseph M. Franey illustrated his design of a snap-on level for golf putters. A partial cylindrical portion snapped on the shaft of the golf putter. Arranged at an integral angular position was a partial cylindrical portion holding a bubble-type level. When the angular position of the shaft was moved to get the bubble into the mid position of the level, then the base of the putter was in a level position, when fully resting on the green.

In respect to such products which are built into golf putters:

In U.S. Pat. No. 4,082,286 in 1978, Ferdinand J. LaBreche illustrated and described his direction and slope indicating putter head. When the golfer is about to swing his or her putter, which is resting on the grass surface, a built in bubble-type level, indicates the then slope of the green. Indicia is presented to assist the golfer in determining the number of inches his or her putt must be directed at the outset, to the right or left of the direct line of the cup of the green to compensate for the respective slope of the contour of the green;

In U.S. Pat. No. 4,902,014 in 1990, Anthony J. Bontomase and David A. Bontomase disclosed their golf putter with a sighting device. The top and mid structure of a putter head was formed with a cylindrical threaded recess. An end for end reversible threaded cylinder containing a level, observable only from one end, was selectively inserted and threaded into place. During a tournament the level could not be observed. During practice and social play, the level was positioned to be observed, to determine the level of the base of the putter when resting on the grass surface of a golf green.

Continuing in respect to such products which are built into golf putters, and where the golf putter is then used, like a carpenter's level, with both the shaft and head of the golf putter being laid on the grass surface of the golf green:

In U.S. Pat. No. 2,919,491, in 1960, George H. Darrell and Charles E. Channing illustrated and disclosed their level indicating putter. An elongated level bulb was fixed within the shaft of the putter and arranged to show a level indication, when both the head and handle of the golf putter were resting upon a level underlying surface. When the grass surface contour of the green was not level, the level was read to determine the slope of the green; and In U.S. Pat. No. 4,179,125 in 1979, Bryan N. Cone and Michael F. Aboussouan, disclosed their level-indicating putter, which they considered as being an improved positioning and securing of the elongated level bulb, in respect to the level indicating putter disclosed in U.S. Pat. No. 2,919,491.

In respect to a product offered in the market place designated as to its source by the trademark Read-Em-Rite, a liquid air bubble level is mounted in the top portion of a two piece housing. The bottom portion, with the top portion together surround a shaft of a putter and eventually they are clamped in position about the shaft. First, however, the putter is laid on a known level surface, and the level bubble is adjusted to the mid-position by using a set screw contained in the top portion. With the level bubble remaining in the mid-position, this product is tightened about the shaft of the putter to so remain during a golfer's outing and/or his or her continuing rounds of golf. The packaging of this Read-Em-Rite product contains the notices, Patent Pending and ® 1990 The Kensington Group.

These prior products all were directed to assisting golfers in their understanding of the various slopes of the contour of a green. They were used in different ways. Some required the use of a specially made golf putter. All of them are recognized for their merits; yet there is room for more products of like purpose.

SUMMARY

A golf green level determining removable accessory is temporarily secured to a shaft of a golf putter by a golfer, when she or he has a golf ball on the green, and initially the directional slope of the green grass surface is not too readily understood by the golfer. The golf putter with the accessory in place may be carefully placed essentially horizontally on the green at right angles to the intended approach of the ball to the cup, preferably near the cup, to determine the transverse slope of this area of the green, upon reading the position of the air bubble of the liquid and air level of this accessory. The golf putter also may be carefully placed essentially horizontally on the green on the intended path of the golf ball, or closely parallel thereto, to determine the longitudinal slope of this area of the green, upon reading the position of the air bubble of the liquid and air level of this accessory.

After making such golf green level reading observations, the golfer will be stroking his or her putt with the selected force appropriate to a level, downhill or uphill longitudinal direction of this surface area of a golf green. Also the golfer will be stroking his or her putt in a selected direction straight to a cup, left or right of a cup of the surface area of the golf green. These combined golf stroke considerations undertaken by the golfer, after observing the golf green level readings, enhance his or her ability to make an accurate putt of the golf ball into the cup on the green.

This removable accessory has an elongated hollow cylindrical housing having an interior to position an elongated sealed liquid and air bubble level; an opening for observing the movement of the air bubble; initially removable ends, which after insertion of the air bubble level, are secured in place; one of these ends preferably having a pointed portion; depending, integral, spaced, arcuate lower sides to closely receive a substantial portion of a shaft of a golf putter; at least one recess to receive and to hold at least one magnet, which provides the holding power to keep this accessory in place on the metal shaft of the golf putter; and a receiving locale near one end between the depending integral spaced arcuate lower sides to position shims or a set screw used in adjusting the position of an accessory on the metal golf shaft, so the bubble reading will be centered at zero, i.e. the mid travel point, when the golf putter, with the accessory in place is supported on a known level surface structure.

When the shaft of the putter is non metallic, then a metal snap on partial sleeve is positioned on the shaft at the location where this accessory, equipped with a magnet, will be placed. This partial sleeve is available as an accessory for the golf green level determining removable accessory, which is always available to be temporarily magnetically secured to a shaft of a golf putter.

DRAWINGS OF A PREFERRED EMBODIMENT

The golf green level determining removable accessory for temporary securement to a shaft of a golf putter is illustrated in the drawings, wherein:

FIG. 1 is a partial perspective view of a portion of a golf green, illustrating how a golfer places a putter transversely to the intended path of the golf ball, near the cup, and then reads the location of the bubble of the liquid and air level of the golf green level determining, removable accessory, to determine whether the golf ball should be directed at the cup or left or right of the cup;

FIG. 2 is a partial perspective view of the same portion of the golf green, illustrating how the golfer places the putter longitudinally on or nearby and parallel to, the intended path of the golf ball, and then reads the location of the bubble of the liquid and air level of the golf green level determining removable accessory, to determine whether the golf ball will be moving along a level path, or uphill or downhill, en route to the cup;

FIG. 3 is a perspective top view of the golf green level determining removable accessory, showing the temporary securement thereof on a shaft of a golf putter, shown only in part, using phantom lines;

FIG. 4 is a side view of the golf green level determining removable accessory, illustrating how a shim or shims are used, if necessary, to calibrate the level position of this accessory, when positioned on the shaft of a golf putter, and also illustrating how one end of this accessory, preferably has a pointed end, whereby the golfer will always position this removable accessory with the pointed end being directed to the same end of the golf putter, either the selected handle end, or the putter head end;

FIG. 5 is a partial longitudinal cross sectional view of the golf green level determining removable accessory, showing the temporary positioning thereof on a shaft of a golf putter, shown only in part and with phantom lines, and further showing: the pointed end; the arc of the liquid and air level, in respect to the vial thereof; the shims; and the spaced placement of three magnets, which provide the magnetic field holding force to keep the accessory in position on a metallic shaft of a golf putter;

FIG. 6 is a top view of the golf green level determining removable accessory, showing the air bubble of the liquid and air level in the centered position, which indicates the level positioning of this accessory, and also illustrating the spaced transverse indicia markings, which are useful when reading the relative positioning of the air bubble, and again the pointed end is shown, which, if located consistently in a definite direction on the shaft of the putter, insures the calibration of the accessory continues to be accurate;

FIG. 7 is a perspective bottom view of the golf green level determining removable accessory, with some portions removed, to illustrate how recesses are provided in the curved concave bottom of this accessory to receive and to hold magnets, which provide the magnetic field strength to temporarily hold this accessory on a metallic shaft of a putter, and again showing a shim, and also the pointed end.

FIGS. 8 and 9 are similar to FIGS. 5 and 7, and these figures illustrate how a set screw is used in lieu of shims; and FIG. 10 is a perspective view of a metal snap-on partial sleeve which is about to be positioned on a non metallic shaft, partially shown, at a location where this accessory, equipped with a magnet, is placed.

DESCRIPTION OF THE PREFERRED EMBODIMENT

The golf green level determining removable accessory 10 is illustrated in a preferred embodiment 10, throughout the FIGS. 1 through 7 of the drawings. In FIG. 1, the positions are shown of the golfer and his or her golf putter 12 on a golf green 14, between where the golf ball 16 lies and the cup 18 is located. The golf green level determining removable accessory 10 is removably placed on the metallic shaft 20 of the golf putter 12, preferably nearer the handle end 22 rather than the putter head end 24. With the putter head 26 lying with the face 28 thereof on the grass 30, this accessory 10 has been placed to be directly observed by the golfer from above, as illustrated in FIG. 1. Also, preferably, this accessory 10 has been placed, via transverse placement of the putter 12 at essential ninety degrees, to be on or nearby the originally intended direction of the putt to be soon made.

If the air bubble 32 of the liquid and air level 34 in vial 36 thereof, supported in the cylindrical recess 37 of the housing 38 of the accessory 10, is observed in its centered location, there is essentially no transverse slope of the golf green 14 in this area of the green 14, where the golf putter 12 has been placed. If the air bubble 32 has moved to the right, the transverse slope of the golf green 14 is to the left, and vice versa.

Also the golf green level determining removable accessory 10 is used in determining whether the longitudinal path of the intended putt of the golf ball 16 is level, or uphill or downhill, as illustrated in FIG. 2. The golfer places his or her golf putter 12 on the intended path 42, or parallel and nearby the intended path 42, of the putt soon to be made, with putter head 26 being placed nearer the cup 18 than the handle 40. If the air bubble 32 remains centered, there is essentially no longitudinal slope of the golf green 14 in this area of the golf green 14, where the golf putter 12 has been placed. If the air bubble 32 has moved toward the cup, the longitudinal slope of the golf green 14 is uphill, and vice versa.

The reading of the position of the air bubble 32 in the liquid and air level 34, in respect to its movement in the vial 36, as observed through the opening 44 in the housing 38, is more readily undertaken in the presence of the spaced transverse parallel indicia 46 created on the exterior of the vial 36, as illustrated particularly in FIGS. 3 and 6. Preferably the elongated sealed liquid and air level is formed in an arc configuration as shown in FIG. 5.

The return to the same effective positioning of the golf green level determining removable accessory 10, on the metallic shaft 20 of the golf putter 12, in respect to the same directional positioning thereof, is insured by having one end thereof called the pointed front end 48, in contrast to the reasonably flat back end 50, always being directed, preferably, to the initially selected putter head end 24, as illustrated in FIG. 1.

When the golf green level determining removable accessory 10 is first fitted to a golfer's putter 12, utilizing a known level surface of a selected support, a shim 52, or shims 52, are used, when necessary. If a shim 52 or shims 52 are used, they are located as illustrated in FIGS. 4, 5 and 7. They are waterproof, flexible, and secured with a releasible, waterproof adhesive, when the shims are required. The number of shims 52 used, will depend on the calibration directed to having the air bubble 32 of the liquid and air level 34 arrive at the centered central volume of the vial 36, and so remain, when the golf putter 12 is resting, undisturbed on a selected level surface support.

In lieu of using one or more shims 52, a set screw 60 is utilized and the amount of its projection out of the hole 62 of the housing 38 is adjusted until the air bubble reaches the mid location for the zero reading, as illustrated in FIGS. 8 and 9.

In respect to this preferred embodiment 10, the housing 38, and both the pointed front end 48 and the flat back end 50, are preferably made via the injection molding of plastic. The ends 48 and 50 fit snugly and, if necessary, an adhesive is used to insure their retention.

The clear plastic vial 36 of the liquid and air level 34 is available in the marketplace, as are the selected sized magnets 54. The relative preferred size of the magnets 54 is illustrated in FIGS. 5 and 7. The housing 38 has a concave bottom 56, with a selected radius, so this concave bottom complementary fits exterior surface portions of a metallic shaft 20 of a golf putter 12. At spaced locations along the concave bottom 56, recesses 58 are formed, preferably at the time of the injection molding manufacturing process, to snugly receive a respective magnet 54. An adhesive may be used to insure the continued holding of the magnets 54. Whether or not one, two or three magnets 54 will be used, depends on the overall magnetic holding power of the selected magnets 54, that is needed to keep the golf green level determining accessory 10 firmly in place, when the golf putter 12 is being positioned on the golf green 14, so the level readings may be quickly and successfully undertaken by the golfer during his or her preparations before putting the golf ball 16.

When the golf green level determining removable accessory 10 is fitted to the golf putter 12, which is generally in the range of being thirty six inches in length, this assembly of the accessory 10 and the golf putter 12 becomes in effect, a thirty six inch long level, which makes the level reading very accurate. The accessory 10 is quickly and easily installed and removed without causing any change in the golf putter 12 itself. The magnetic force does not cause any damage to the golf putter 12, or to the accessory 10. Most golf putters 12 of most sizes and shapes, without alterations thereof, can be fitted with this accessory 10. Therefore, the golfer, who selects another golf putter 12 for his or her use, can easily remove the golf green level determining removable accessory 10 from the metallic shaft 20 of the first golf putter 12, and secure it, via the magnetic force, to the metallic shaft 20 of the second golf putter 12. The golfer then continues on being able to better pre-analyze how he or she should hit the golf ball 16, in respect to speed and direction, so the golf ball 16 will drop into the cup 18.

If a golfer initially has or later purchases a golf putter having a non metallic shaft 66, then a metal snap on partial sleeve 64 is positioned on the non metallic shaft 66 at the location where this accessory 10, equipped with a magnet 54, will be placed, as shown in FIG. 10. It remains in place.

A golfer will keep his or her golf green level determining removable accessory 10 in a convenient place, preferably in his or her pocket, or supported by the golf bag. Then when time permits during practice or during a round of golf, the golfer will temporarily and quickly position this accessory 10 on the putter. Thereafter as the putter is quickly laid on the green at one, two or more locations, the contour of the green will be better understood, upon reading the position or positions of the air bubble. Then with this accessory 10 preferably removed, the putter is used to continue on with the putting, with the hope that the first putt will go all the way to and into the cup.

This accessory 10, allows the golfer, who really wants to improve his or her putting game, to first read the green in preparation for putting, without using this accessory 10. Then with the aid of this accessory 10, attached to the putter shaft, the golfer verifies his or her initial reading. If the reading of the accessory 10 verifies the golfer's first reading of the green, then the golfer proceeds to putt with confidence. If, on the other hand, the reading of the accessory 10 does not confirm the golfer's initial reading, made without the help of the use of the accessory 10, the golfer then has the opportunity to re-analyze the contour of the green and to correct the intended direction of his or her subsequent putting stroke.

When these steps are undertaken, they serve as the basis for a distinct learning process at a most critical time, i.e. before the putting stroke is made, to direct the golf ball on its way to the cup. By using this golf green level determining removable accessory 10, at selected convenient times, a golfer improves his or her overall, i.e. all the time, skill in reading the contours of golf greens.

I claim:

1. A golf green level determining removable accessory for quick temporary securement to a shaft of a golf putter which is either a metal shaft, or, if non metallic, has an additional accessory of a metallic snap on sleeve for the non metallic shaft of sufficient length to receive this removable accessory on the shaft, whereby, with this removable accessory, when a putter is laid down on a golf green, it is in effect a level tool having the length of the golf putter and then a golfer's reading of the indicated level, at the selected location on a golf green, will assist him or her in deciding upon the initial direction and/or speed of the golf ball to be putted, comprising:

a. a housing formed to receive an elongated sealed liquid and air bubble level, and to receive at least one magnet;

b. an elongated sealed liquid and air bubble level received and held in the housing; and c. a magnet received and held in the housing; and d. a metallic snap on sleeve for attachment to a non-metallic putter shaft.

2. A golf green level determining removable accessory, as claimed in claim 1, wherein the housing has the ends thereof formed differently, whereby a specific end of the housing will always be arranged in the same pointing direction along a shaft of a golf putter.

3. A golf green level determining removable accessory, as claimed in claim 2, wherein the housing has cylindrical recess to receive and to hold the elongated sealed liquid and air bubble level.

4. A golf green level determining removable accessory, as claimed in claim 3, wherein the housing has a concave bottom with a selected radius, whereby this concave bottom complementary fits the exterior surface of a portion of a shaft of a golf putter.

5. A golf green level determining removable accessory, as claimed in claim 4, comprising, in addition, an adjustable projectable structure, such as a shim or set screw, positioned at the concave bottom near one end thereof, to serve as a calibration structure, whereby, when initially positioning this accessory on a shaft of a putter, when a putter is laid on a level surface, the adjustable projectable structure is adjusted, if necessary, during the calibration, so the level reading will be a zero reading.

6. A golf green level determining removable accessory, as claimed in claim 5, wherein the elongated sealed liquid and air bubble level is formed in a longitudinal arc configuration.

* * * * *